United States Patent [19]

Zublin

[11] Patent Number: 4,518,041

[45] **Date of Patent: * May 21, 1985**

[54] HYDRAULIC JET WELL CLEANING ASSEMBLY USING A NON-ROTATING TUBING STRING

[76] Inventor: Casper W. Zublin, 801 Hewlett, Bakersfield, Calif. 93309

[ * ] Notice: The portion of the term of this patent subsequent to Apr. 17, 2001 has been disclaimed.

[21] Appl. No.: 360,492

[22] Filed: Mar. 22, 1982

Related U.S. Application Data

[63] Continuation-in-part of Ser. No. 337,371, Jan. 6, 1982, Pat. No. 4,442,899.

[51] Int. Cl.[3] ..... E21B 37/00; B08B 9/02

[52] U.S. Cl. ..... 166/312; 166/222; 239/255; 239/DIG. 13; 134/167 C; 134/179

[58] Field of Search ..... 166/312, 311, 222, 223, 166/72, 73, 67, 171, 177, 378, 379; 175/422; 299/16, 17; 239/251, 252, 255, 256, 261, DIG. 13; 134/167 C, 168 C, 176, 179, 198; 15/104.03, 104.05, 104.09

[56] References Cited

U.S. PATENT DOCUMENTS

| | | | |
|---|---|---|---|
| 2,245,575 | 6/1941 | Court | 134/179 |
| 2,735,794 | 2/1956 | Pletcher | 134/167 C |
| 3,547,191 | 12/1970 | Malott | 166/223 |
| 3,585,076 | 6/1971 | Prange | 134/167 C |
| 3,598,316 | 8/1971 | Johnson | 239/256 |
| 3,994,310 | 11/1976 | Brandon | 134/167 C |
| 4,164,325 | 8/1979 | Watson | 239/252 |
| 4,349,073 | 9/1982 | Zublin | 166/312 |
| 4,361,282 | 2/1981 | Divito | 239/DIG. 13 |
| 4,442,899 | 4/1984 | Zublin | 166/312 |

*Primary Examiner*—Stephen J. Novosad
*Assistant Examiner*—Hoang C. Dang
*Attorney, Agent, or Firm*—Knobbe, Martens, Olson & Bear

[57] ABSTRACT

A method and system for cleaning well liners employing a non-rotating tubing string attached to a hydraulic jet carrier assembly is disclosed. The assembly has a plurality of jet nozzles spaced along its length, each of said nozzles expelling a stream of fluid under pressure against the liner with a force which has an equal and opposite reactive force. At least some of the nozzles are oriented along the carrier such that the reactive force for each jet is directionally offset with respect to the central axis of the carrier, thereby creating a twisting moment tending to rotate the carrier about its central axis. During the cleaning operation, the bottom hole differential pressure of the fluid supplied to the jet carrier is varied to rotationally displace the carrier as it is moved vertically within the well bore. Moreover, in a preferred embodiment, the angle of rotational displacement can be calculated which will produce at least double coverage of the jet streams against the liner.

35 Claims, 12 Drawing Figures

Fig. 1
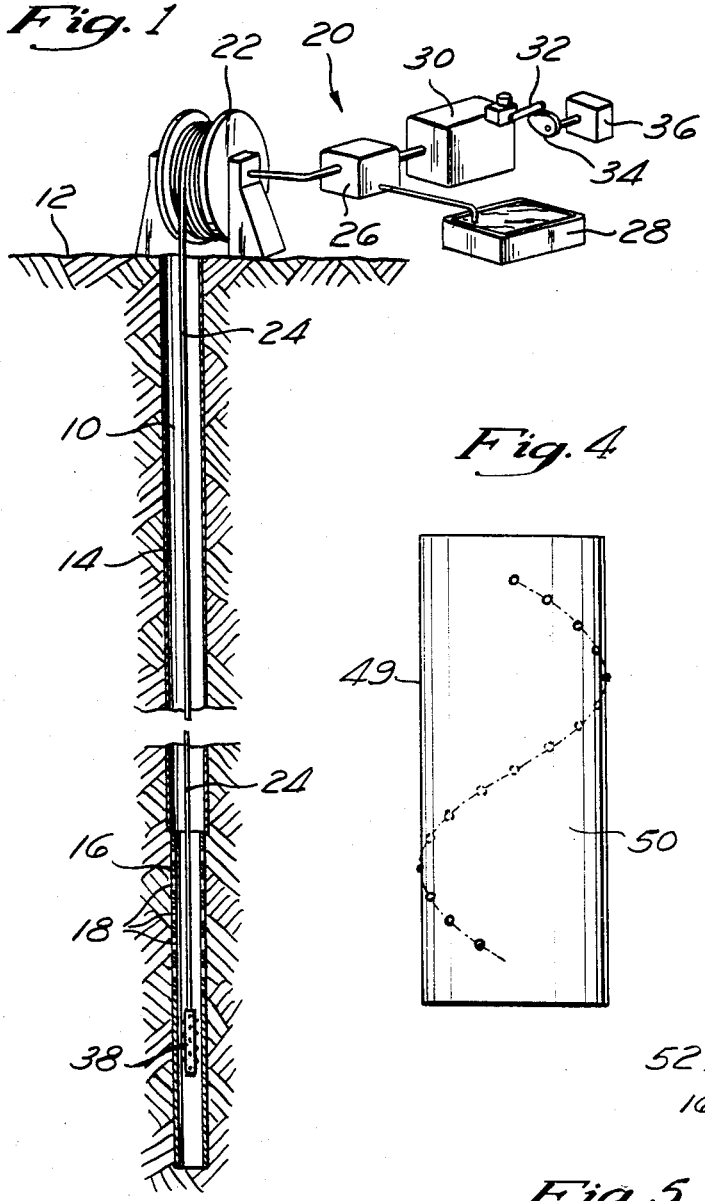
Fig. 2
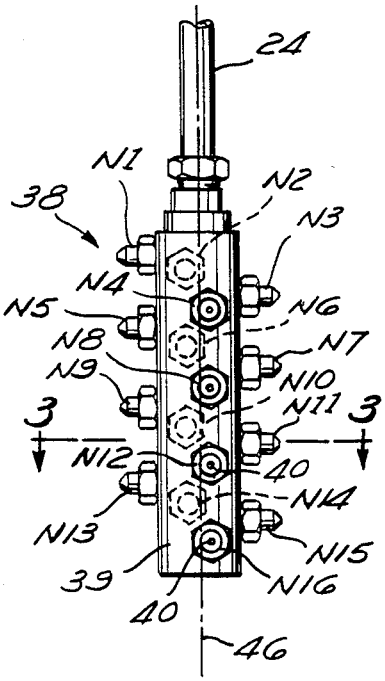
Fig. 4
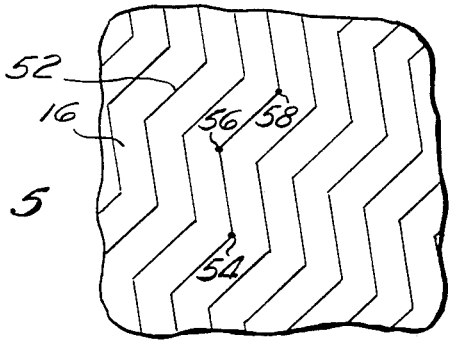
Fig. 5
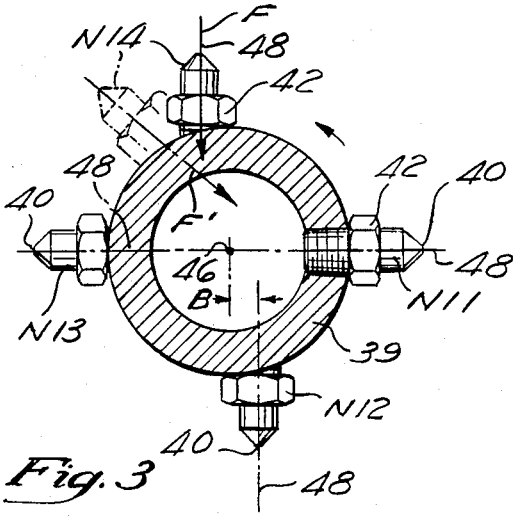
Fig. 3
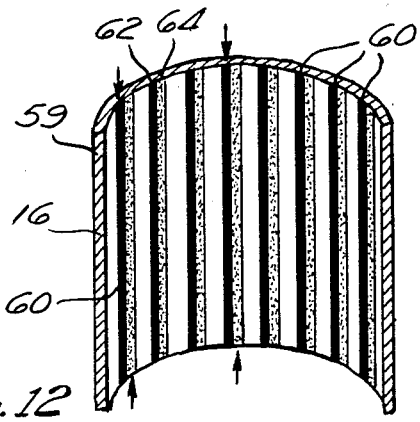
Fig. 12

HYDRAULIC JET WELL CLEANING ASSEMBLY USING A NON-ROTATING TUBING STRING

CROSS REFERENCE TO RELATED APPLICATIONS

This application is a continuation-in-part of co-pending application Ser. No. 337,371 filed Jan. 6, 1982 entitled Hydraulic Jet Well Cleaning Assembly Using a Non-Rotating Tubing String now U.S. Pat. No. 4,442,899.

BACKGROUND OF THE INVENTION

The invention is specifically directed to a method and system for cleaning perforated, slotted and wire wrapped well liners which become plugged with foreign material by means of devices using high velocity liquid jets. Specifically, a method and system is employed with a tubing string that is non-rotating. It will be understood that in certain instances the inventive method and system can be applied to cleaning pipes in general and as used herein the term "pipe" shall include well liners.

In the well producing art, it is customary to complete wells, such as water, oil, gas, injection, geothermal, source, and the like, by inserting a metallic well liner adjacent a fluid-producing formation. Openings in the well liner provide passage-ways for flow of fluids, such as oil or water and other formation fluids and material from the formation into the well for removal to the surface. However, the openings, which, for example, may be slots preformed on the surface or perforations opened in the well, will often become plugged with foreign material, such as products of corrosion, sediment deposits and other inorganic or hydrocarbon complexes.

Since removal and replacement of the liner is costly, various methods have been developed to clean plugged openings including the use of jetted streams of liquid. The use of jets was first introduced in 1938 to directionally deliver acid to dissolve carbonate deposits. In about 1958 the development of tungsten carbide jets permitted including abrasive material in a liquid which improved the ability of a fluid jet to do useful work. However, the inclusion of abrasive material in a jet stream was found to be an ineffective perforation cleaning method in that it enlarged the perforation which destroyed the perforation sand screening capabilities.

More recently, Chevron Research Company, disclosed a method and apparatus for directionally applying high pressure jets of fluid to well liners in a number of U.S. patents. These patents are U.S. Pat. Nos. 3,720,264, 3,811,499, 3,829,134, 3,850,241, 4,088,191 which are herein incorporated by reference.

The applicant of the subject application developed a cleaning operation and device pursuant to the Chevron disclosures. The system employed a jet carrier of about six feet length, having eight jet nozzles widely spaced along its length. The nozzles were threadably mounted on extensions which were in turn welded to the jet carrier. The jet carrier was attached to a tubing string that could be vertically reciprocated and horizontally rotated within the well bore. As the carrier was moved vertically and rotated adjacent the liner, the nozzles directed jet streams which contacted and cleaned the liner. This design developed a number of problems one of which was that there was no known relationship between the vertical and rotational speed which would assure efficient and complete liner coverage by the fluid streams.

In an attempt to solve these problems, Applicant developed its own jet carrier assembly fully described in co-pending application, Ser. No. 195,303, filed Oct. 7, 1980, which is herein incorporated by reference. This assembly has between about 8 and 16 nozzles spaced along its length. An equation is used to determine the jet stream track pattern against the liner for a jet tool having a given nozzle number and spacing and which is rotated and moved vertically at selected speeds. The spacing between the tracks is then calculated from this track pattern. Comparing the spacing with the known width of a jet stream determines the amount of coverage the streams provide on the liner. Using this equation, a set of rotational and vertical speeds of a constant ratio were determined which would provide jet streams having theoretical double coverage over all points on the liner when using 16 nozzles.

Although the design was a major advance in the art, it did not attempt to relate the rotational and vertical speeds to the diameter of the liner. To solve this problem, Applicant developed a system in which the energy needed to clean the liner is determined and related to the factors which the operator can control in the field. After determining the energy needed to clean the liner, the power drop between the nozzle and the liner is calculated as a dependency of the stand-off distance, ie. the distance of the jet from the liner. Knowing the power drop, one can determine the total energy of the streams at the nozzles needed to produce the required cleaning energy at the liner. The rotational speed and maximum vertical speed are then calculated which will produce this total energy for a given liner size and given plugging condition. This system is fully disclosed in co-pending application Ser. No. 308,582 filed Oct. 5, 1981, entitled "method and device for hydraulic jet well cleaning," which is herein incorporated by reference.

Although Applicant's systems described above are quantum advances in the art of well cleaning, they employ a high pressure rotating swivel, which is, in turn, rotatably connected to a tubing string. The fact that the tubing string is freely rotatable permits rotation of the carrier by the jet streams as the carrier is moved vertically. In short, these carriers are not applicable to non-rotating tubing strings.

A safe and economically efficient alternative to jointed tubing or conventional rigs is the coiled tubing rig. In general, coil tubing is a continuous string of small diameter tubing that can be run into the well from a large reel without the necessity of making joint connections. This operation, therefore, saves rig time. Many workover operations can be completed quickly and efficiently by using coiled tubing instead of the convention rigs. Moreover, theoretical burst pressures of typical coiled tubing are on the order of between 11,400 psi and 14,500 psi. This is well above the operating pressure for hydraulic jet cleaning. Finally, coiled tubing can be run in and out of the well bore at much greater speed then conventional tubing rigs, e.g., 200 ft/min. for coiled tubing rigs versus 30–60 ft/min. for conventional rigs.

The problem with employing coiled tubing rigs with hydraulic jet well cleaning is that because the coiled tubing is wound on a reel, the tubing string is not rotatable in the conventional manner such as by rotating swivel. Applicant is not aware of any hydraulic jet well cleaning operations developed by others employing non-rotating tubing strings such as formed of coiled tubing. A "non-rotating" tubing string as used herein shall mean a string which is not conveniently rotatable.

As a result, a strong need exists for a method and system for cleaning well liners which can be employed with non-rotating tubing strings and which will clean the particular foreign material present in a controllable, economical field operation.

SUMMARY OF THE INVENTION

The inventive method and system employs a non-rotating tubing string which is attached to a jet carrier having a central axis and a plurality of nozzles spaced along its length, each nozzle expelling a stream of fluid under pressure against the liner with a force which has an equal and opposite reactive force.

At least some of the nozzles are oriented on the carrier such that the reactive force is directionally offset from the carrier's axis, creating a twisting moment or torque about the axis, tending to angularly displace the carrier. This displacement angle is dependent upon the length of tubing, the torsional modulus of elasticity of the tubing, the inside and outside diameter of the tubing, the amount of offset of the reactive force, the diameter of the jet nozzle orifice, the number of jet nozzles and the differential bottom hole pressure of the water.

For a given operation at a given depth within the well bore, the displacement angle is dependent upon the differential bottom hole water pressure only, all other parameters being fixed. Changing the pressure changes this angular displacement. Thus, by changing the pressure the carrier will be rotationally displaced thereby increasing the area on the liner covered by the fluid streams. During the cleaning operation the carrier is moved vertically along the well bore while the pressure is varied producing fluid stream coverage which removes the foreign material.

The inventive method avoids the inefficiency in both time and resources of using conventional rotating rigs by permitting the use of non-rotating tubing strings in an efficient and effective cleaning operation.

This significant advance in the art will be clarified and discussed in the following section with reference to the following drawings, in which:

FIG. 1 is an elevation view partially in section, illustrating a jet carrier assembly within a well bore attached to a non-rotating tubing string;

FIG. 2 is a side view of a jet carrier assembly, showing a particular nozzle configuration;

FIG. 3 is a sectional view taken through line 3—3 of FIG. 2;

FIG. 4 is a side view of a jet carrier assembly, illustrating a first embodiment of a jet nozzle configuration with the nozzle locations shown as points;

FIG. 5 is a schematic illustration of the track pattern of the jet streams against the well liner produced by the nozzle configuration shown in FIG. 4 in which pressure is cycled during each pass;

FIG. 12 is a schematic illustration of the track pattern of the jet streams produced by the nozzle configuration shown in FIG. 4 or 6 in which the pressure is varied before each pass, but kept constant during each pass.

DETAILED DESCRIPTION OF THE PREFERRED EMBODIMENT

Figure 10:
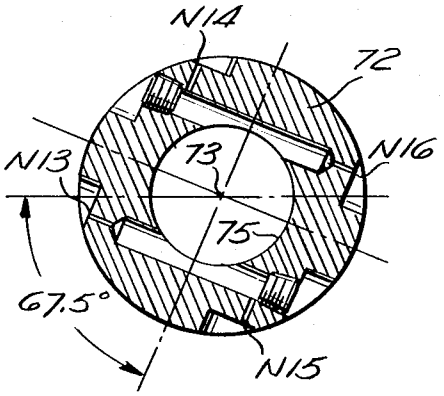
FIG. 10 is a sectional view taken through line 10—10 of FIG. 6.
Figure 9:
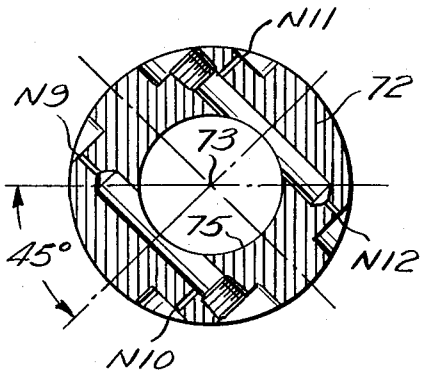
FIG. 9 is a sectional view taken through line 9—9 of FIG. 6.
Figure 8:
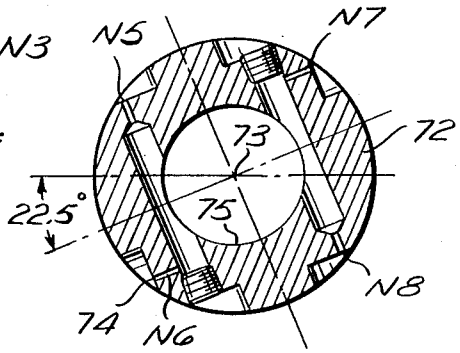
FIG. 8 is a sectional view taken through line 8—8 of FIG. 6.
Figure 7:
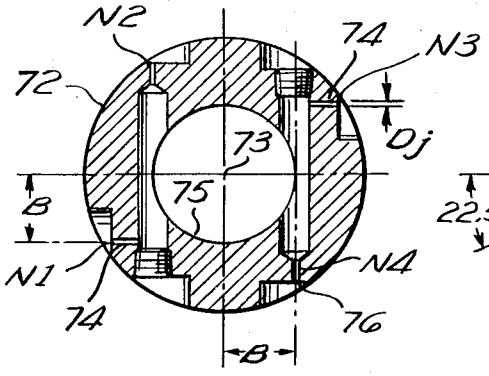
FIG. 7 is a sectional view taken through line 7—7 of FIG. 6.

Referring to FIG. 1, a well 10 is shown drilled into the earth's surface 12. The upper portion of the well 10 is cased with a suitable string of casing 14. A liner 16 having openings 18 is hung from the casing 14 and extends along the producing formation. The openings 18, which may be slots or perforations, permits flow of the formation fluids from the formation into the interior of the well 10. As the formation fluids are produced, the openings 18 in the slotted liner 16 tend to become plugged by depositions of scale, hydrocarbons, clay and sand. The plugging material in the various slots will vary in composition and depending upon the composition will be more or less difficult to remove. As the slots become plugged, production from the well declines. Once it has been determined that the openings 18 in the well liner 16 have become plugged to the extent that cleaning is required for best operation of the well, a hydraulic jet cleaning apparatus 20, shown schematically in FIG. 1, is assembled to accomplish such cleaning.

The apparatus 20 includes a reel 22, around which is wound a tubing string 24. The tubing string is non-rotating, since it is wound around the reel 22. An example of such a tubing string is coiled tubing which is a continuous string of small diameter steel tubing commonly having a $\frac{3}{4}$ inch, 1 inch or $1\frac{1}{4}$ inch diameter. The theoretical burst pressures of coiled tubing having these dimensions are 12,900 psi, 14,500 psi, and 11,400 psi, respectively. The tubing string 24 extends into a jet carrier assembly 38 adjacent the slotted liner 16.

A pump 26 provides the tubing string 24 with a fluid under high pressure obtained from a fluid reservoir 28. The fluid is commonly water which may be mixed with chemical additives. The fluid travels down the tubing string 24 to the jet carrier assembly 38, from which it is jetted. The pump 26 is powered by an engine 30 having a throttle 32 which controls the speed of the engine. In one embodiment, the throttle 32 is, in turn, connected through a cam mechanism 34 with a timer 36.

In many applications prior to cleaning, a conventional jointed tubing rig will already be in place within the wellbore. In using the inventive system, the non-rotating tubing string 24, may be lowered into the wellbore within the hollow center of the existing jointed tubing string. Thus, the carrier 38 and the tubing string 24 must be lowered until the carrier 38 extends below the existing jointed tubing string in order that the nozzles are clear to jet water against the liner. Due to this relationship, the distance between the jet carrier 38 and the liner 16 is larger than encountered with hydraulic jet-well cleaning using rotatable tubing strings as disclosed in pending application Ser. No. 195,303 filed Oct. 7, 1980 and Ser. No. 308,582, filed Oct. 5, 1981. In short, the standoff distance between the liner and the carrier is larger. As a result, it has been found advantageous to include high molecular weight long chain polymers as an additive in the water. In the hydraulic jet-well cleaning system disclosed by the Chevron Research Company in U.S. Pat. Nos. 3,720,264, 3,811,499, 3,850,241, 4,088,891 the standoff distance is given as approximately 6 to 10 times the diameter of the jet orifice. These polymers permit the standoff distance to be enlarged to 60 to 100 times the diameter of the jet orifice.

The addition of the long chain polymers, therefore, provides about a tenfold increase in the standoff distance. This is because the polymers provide a focusing effect of the jet streams. The polymers should be about 30 to 40 p.p.m. of the total fluid, but can vary significantly depending upon the exact polymer used. One polymer found satisfactory is marketed by Berkeley Chemical Research, Inc., P.O. 9264, Berkeley, Calif. 94709, under the trademark SUPER WATER.

Referring to FIG. 2, an example of a jet carrier assembly 38 which can be employed in the inventive method and system is shown in a side elevational view. As will become clear, jet carriers having different nozzle numbers, orientations and spacing along the carrier 38 may be used. The tubing string 24 threadably engages the upper portion of the carrier 38 to form a water-tight seal therebetween.

The jet carrier 38 has an exterior body 39 which has a fluid channel running therethrough for passage of the high pressure fluid supplied by the pump 26. The carrier 38 is coaxial with respect to the tubing string 24 and has an axis 46 which runs through the center of the carrier 38.

The carrier 38 has nozzles N1 through N16 spaced along the length of the body 39, each having a jet orifice 40. Each of the nozzles N1 through N16 is threaded into a hexagonally-shaped adapter labeled generally as 42. The adapters 42 are in turn threadably mounted within adapter seats. A more detailed description of the precise structure and engagement of the nozzles N1 through N16 with the adapters 42 is given in co-pending application Ser. No. 195,303.

The nozzles N1 through N16 are spacially located about the exterior body 39 of the carrier 38, to form four vertically stacked spirals. Referring to FIGS. 2 and 3, the nozzles N1, N2, N3, N4 form the first spiral, nozzles N5, N6, N7, and N8 form a second spiral, nozzles N9, N10, N11, and N12 form a third spiral, and nozzles N13, N14, N15, and N16 form a fourth spiral. The spirals are stacked one above the other such that every fourth nozzle is located directly above (or below) a corresponding nozzle from an adjacent spiral. Thus, for example, nozzles N4, N8, N12 and N16 form a vertical column of axially spaced nozzles. Moreover, the axial spacing between such corresponding nozzles is equal.

As shown in FIG. 3, each nozzle, N1 through N16 can be conceptualized as having a central axis 48 extending through the jet orifice 40. The axes 48 of each adjacent nozzle are mutually perpendicular. Referring to FIGS. 2 and 3, each axis 48 of the even numbered nozzles N2, N4, N6, N8, N10, N12, N14, and N16 is offset a distance, labeled B in FIG. 3, from the axis 46 of the carrier 38. Distance B is the perpendicular distance between the carrier axis 46 and the nozzle axis 48. The even numbered nozzles have been oriented so that the offset distance B of each nozzle is equal. In this embodiment, the odd numbered nozzles N1, N3, N5, N7, N9, N11, N13, and N15 are oriented so that each axis 48 intersects the axis 46 of the carrier 38. This is most clearly shown in FIG. 3 with respect to nozzles N11 and N13.

During a cleaning operation, high pressure fluid is pumped down the tubing string 24 at bottom hole differential pressures of between about 6500 and 8000 psi. It will be understood that the pressure of the fluid at the hole bottom may differ from the pressure of the fluid at the pump 26. However, given the pressure at the pump 26, the bottom hole differential pressure can be calculated by one of ordinary skill in the art. The fluid will be jetted out of the nozzle orifices 40 from the nozzles N1 through N16. The fluid under high pressure will exert a force against the liner 16 which removes the foreign material which plugs the perforatitons 18. This fluid force against the liner has an equal and opposite reactive force F, which is directed along the axis 48 in a direction toward the center of the carrier 38. A typical force vector labeled F is shown in FIG. 3, having a direction shown by the arrow. Since the reactive force is directed along the nozzle axis 48, with reference to the even numbered nozzles, the force is offset the distance B from the central axis 46 of the carrier 38.

The reactive force F, which is equal and opposite to the force of the water through the orifice 40, is given by the following equation:

$$F=P\times A \tag{1}$$

wherein,

P = the bottom hole differential pressure of the water in psi;

A = the cross-sectional area of the jet orifice.

As an example, if the bottom hole differential pressure of the water is 7238 psi and the diameter of the jet orifice $D_j$ is 0.0325 inches in diameter the reactive force for a single nozzle will be as follows:

$$F=(7238)(3.14)(0.0325/2)^2=6 \text{ lbs.}$$

With respect to the even numbered nozzles, the force F creates a torque, T, about the carrier 38 tending to rotate the carrier in a counter clockwise direction as shown by the small arrow in FIG. 3.

The value of the torque created by each nozzle is given by the following equation:

$$T=F\times B \tag{2}$$

wherein,

T = the twisting moment or torque in in.-lbs;

F = the reactive force for each nozzle in pounds.;

B = The offset distance of the reactive force from the carrier axis in inches.

Using the equation above, one can calculate the torque for one of the even numbered jets. For example, if the reactive force for each nozzle is 6 pounds, and the distance B is one inch, then the torque is calculated as follows:

$$T = 6 \text{ lbs.} \times 1 \text{ inch} = 6 \text{ in.-lbs.} = .5 \text{ ft.-lbs.}$$

It should be understood that each of the even numbered nozzles creates a torque that tends to rotate the carrier 38 in a counter clockwise direction. This is true because the force for each even numbered nozzle is acting upon the same side of an imaginary lever arm through the axis 46 of the carrier 38. If desired, for any reason, the even numbered nozzles could be oriented differently on the body of the carrier 38 so that some of the reactive forces would produce a torque tending to rotate the carrier in a clockwise direction. For example, shown in FIG. 3 is a phantom view of the nozzle N14 tilted somewhat in its position on the carrier 38, so that its reactive force, F', would tend to create a torque in a clockwise direction. However, in the preferred embodiment, the reactive forces of the even numbered nozzles all create a torque in the same direction. Therefore, the total torque created by all of the even numbered jets can be calculated by multiplying the torque for one jet by the number $N_j$ of even numbered jets. Thus, in a preferred embodiment, having 16 nozzles, eight of which are offset, and assuming the torque value per nozzle calculated above, the total torque for the carrier 38 would be as follows:

$$T\,(\text{total}) = T\,(\text{per nozzle})\,(N_j) = .5\ \text{ft.-lbs.} \times 8\ \text{nozzles} = 4\ \text{ft.-lbs.} \quad (2a)$$

The total torque of all of the nozzles N1 through N16 will tend to rotate the carrier 38 and tubing string 24 until the total torque is counterbalanced by the inherent resistance of the tubing string 24 to such twisting. This resistance, or back torque, is a function of the torsional modulus of elasticity of the material comprising the tubing string.

The amount of rotation produced by the total torque, i.e., the angular displacement "a", can be calculated by using the following equation:

$$a = 584 T l N_j / (D^4 - d^4) G$$

wherein,

T = the twisting moment per nozzle in in.-lbs;
l = the length of the tubing in inches;
$N_j$ = the number of offset jets
D = the outside diameter of the tubing in inches;
d = the inside diameter of the tubing in inches;
G = the torsional modulus of elasticity.

The above equation is a standard equation taken from machinery's Handbook, 20th Edition, Industrial Press 1976.

For a given embodiment, the outside diameter and inside diameter of the tubing and the torsional modulus of elasticity will be a constant. The variables affecting the amount of angular displacement will therefore be the length of the tubing and the twisting moment. The twisting moment is dependent upon the pressure of the water and the number of nozzles which are offset since the area of the jet orifice can be considered to be a constant and in the preferred embodiment the distance B is a constant for all of the even numbered nozzles. In short, the parameters which are variables in the field are the length of the tubing, i.e., the depth of the cleaning operation, the number of nozzles and the pressure.

In the embodiment shown in FIGS. 2–3, only the even numbered nozzles are shown offset with respect to the axis 46 of the carrier 38. However, it should be understood that carriers having differing numbers of offset nozzles are possible. For example, various combinations of even and odd numbered nozzles could be offset or all 16 nozzles could be offset.

In the preferred embodiment at least some of the nozzles are oriented so that their axes 48 intersect the carrier axis 46. In this orientation, nozzles clean the openings 18 of the liner 16 most effectively and efficiently. This is true because perforations on a liner are generally aligned so that the axis of the perforation intersects the vertical axis of the liner. Thus, if the nozzle is oriented such that its axis intersects the axis of the carrier, the axis of the nozzle will be essentially coincidental with the axis of the perforation. The full force of the jet stream thereby hits the perforation providing maximum cleaning power from the nozzle.

The following example will assume all 16 nozzles are offset:

P = 5,000 psi
A = (3.14)(0.325/2)$^2$
B = 1"
l = 5,000' = 60,000"
D = 1.25"
d = 1.082"
G = 11,500,000 psi
$N_j$ = the number of nozzles = 16

The angular displacement, a, using the above equation with these values is 188 degrees.

For a given bottom hole differential pressure, depth and number of jets, an angular displacement can be calculated. The following is a chart providing the angular displacements for various values of pressure, jet numbers and tubing depth.

| PSI | No. of Jets | Twisting Moment | Depth (1) | Degrees Displaced | Depth (1) | Degrees Displaced |
|---|---|---|---|---|---|---|
| 5000 | 16 | 66 | 5000 | 188° | 8000 | 301° |
| 6000 | " | 80 | " | 227° | " | 364° |
| 6500 | " | 86 | " | 245° | " | 392° |
| 7000 | " | 93 | " | 265° | " | 424° |
| 7500 | " | 100 | " | 284° | " | 455° |
| 8000 | " | 106 | " | 302° | " | 482° |
| 6000 | 14 | 70 | " | 199° | " | 319° |
| 6500 | " | 75 | " | 214° | " | 342° |
| 7000 | " | 81 | " | 231° | " | 369° |
| 7500 | " | 87 | " | 248° | " | 396° |
| 8000 | " | 93 | " | 265° | " | 424° |
| 6000 | 12 | 60 | " | 171° | " | 273° |
| 6500 | " | 65 | " | 185° | " | 296° |
| 7000 | " | 70 | " | 199° | " | 319° |
| 7500 | " | 75 | " | 214° | " | 342° |
| 8000 | " | 80 | " | 228° | " | 364° |

The above chart assumes:
Tubing D = 1.25", d = 1.082"
$D_j$ = 0.0325", B = 1

It should now be understood that for a given depth and number of jet nozzles, the twisting moment, T, and the angular displacement, a, can be varied by varying the pressure. For example, in the chart above if the pressure equals 7500 psi then the total torque produced by 16 nozzles will equal 100 ft.-lbs. This torque will produce a total angular rotation of the tubing of 284° at a depth of 5,000 ft. If the bottom hole differential pressure is kept constant the tubing will remain twisted at this particular angle. However, if the pressure is increased to 8000 psi the total torque will be increased to 106 foot-pounds. This translates into a total angular displacement of 302°. Thus, if the water pressure is increased from 7500 to 8000 psi the tubing will have a net angular displacement of 18°. In the embodiment shown in FIG. 3 an increase in psi will increase the torque and create a net angular displacement in a counter clockwise direction. If the pressure is then decreased to 7500 psi, the torque will decrease and the angular displacement will decrease a net 18° in the opposite (clockwise) direction.

It should be understood that the nozzle configuration shown in FIG. 2, i.e., forming four stacked spirals, is only one example of many configurations which could be employed in the inventive system. A second embodiment of a nozzle configuration is shown in FIG. 4. Referring to FIG. 4, a jet carrier 49 is shown having an exterior body 50. The position of each nozzle is represented by a point. Sixteen nozzle locations are shown in FIG. 4 forming one complete revolution, i.e., 360 degrees. Each nozzle is axially spaced along the carrier body 50 a sufficient distance such that the 16 nozzles form a single spiral about the exterior body 50 of the carrier 49.

A third embodiment of a nozzle configuration is illustrated in FIGS. 6–10. A jet carrier 70 is shown generally having an outer body 72 and a central vertical axis 73. The body 72 has a hollow center 75 with sixteen nozzles N1–N16 formed by narrow fluid channels generally referred to as 74 (see FIG. 7) which extend from the hollow centers radiating outward in connection with the exterior of the carriers. Each nozzle has a central axis 76 which is offset the distance B from the central axis 73 of the carrier. The diameter of the orifice of each nozzle is $D_j$ (see FIG. 7). The nozzles N1–N16 are located in a four-tier arrangement such that the axes 76 of nozzles N1–N4, nozzles N5–N8, nozzles N9–N12 and nozzles N13–N16 lie in four axially spaced, mutually parallel planes. As most clearly shown in FIGS. 7–10, the nozzles in each tier are circumferentially spaced so that the sixteen nozzles are circumferentially spaced an equidistance from each other. Thus, each nozzle is circumferentially spaced 22.5° from its circumferentially closest neighbor.

The result of this nozzle configuration is to produce sixteen streams of fluid whose center-to-center spacing at the target is 22.5°. This is best shown in FIG. 11, which schematically illustrates sixteen streams of fluid shown as arrows 78 eminating from the carrier 70, which strike the liner 16 in the direction as shown by the arrows 78.

Figure 11:
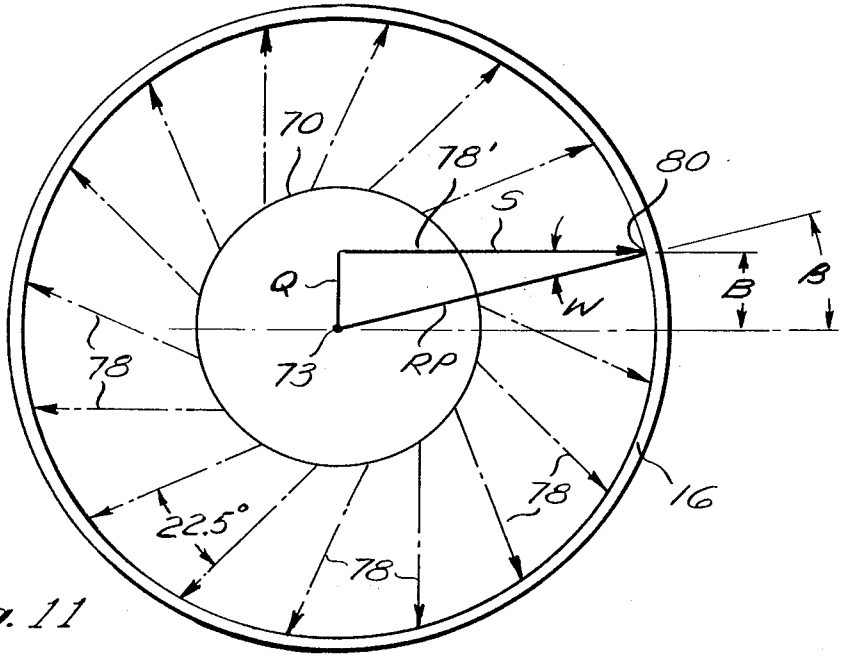
FIG. 11 is a schematic illustration of the jet streams produced by the jet carrier shown in FIG. 6 as they hit the well liner at an instantaneous moment.
Figure 6:
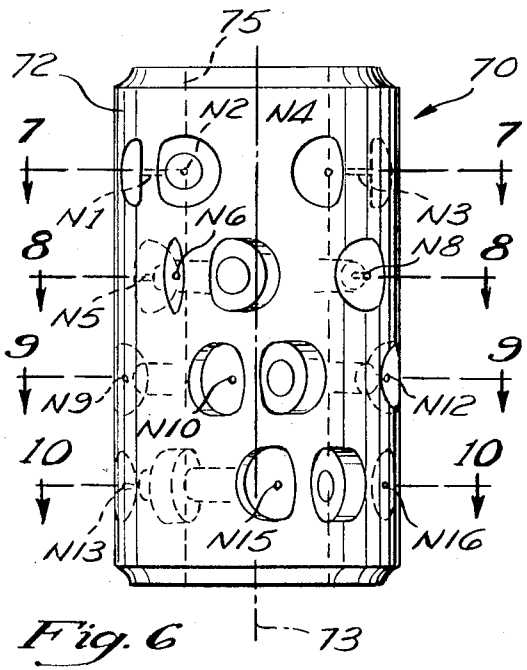
FIG. 6 is a side view of a jet carrier assembly illustrating a second embodiment of a jet nozzle configuration.

Each of the streams illustrated in FIG. 11 strike the liner 16 obliquely. This is because the nozzles N1–N16 of the carrier 70 are offset with respect to the axis of the carrier 73. One arrow 78' has been extended radially inward forming a vector S that intersects a lever arm Q whose length, B, represents the offset distance of the arrow 78' from the axis 73. The vector S intersects the lever arm Q at right angles. A right triangle is then formed by drawing a vector $R_p$ between the axis 73 and a point 80 which represents the point at which the arrow 78' strikes the liner 16. This vector $R_p$ represents the radius of the liner 16.

THe arrow 78' strikes the liner 16 at an acute angle W formed between vectors S and $R_p$. It should be understood that although the nozzles N1–N16 shown in FIGS. 6–10 are depicted as all offset from the axis 73 of the carrier, as described earlier, some of these nozzles may be oriented to achieve optimum efficiency, i.e., with their axes intersecting the axis 73 of the carrier. Such nozzles would produce streams that strike the liner 16 perpendicularly such as the path transversed by the vector $R_p$.

Now that various alternative embodiments of jet carriers have been shown, the methods of operating such carriers will be discussed.

In general, there are two alternative methods in which a carrier such as the carrier 38 is moved vertically in upward and downward passes adjacent the interval of the liner to be cleaned. In a first preferred method, the jet carrier 38 is moved vertically up the wellbore while the value of the pressure is cycled. For example, if the pressure were cycled between 8000 and 7500 psi during a single pass, the tubing would oscillate in alternating clockwise and counter clockwise directions 18°. Therefore, by varying the pressure during a pass, a continuing reciprocating rotational movement is produced. In order to cycle the pressure, the speed of the engine 30 which controls the pump 26 must be cycled. In order to cycle the speed of the engine 30, a timer 36 actuates a cam mechanism 34 which mechanically moves the engine throttle 32 as will be well understood by those of ordinary skill in the art. In this way the pressure is varied as the jet carrier 38 is moved vertically along the wellbore, creating a horizontal oscillation of the carrier.

The angular displacement of the oscillation can be controlled by reference to the chart given above by controlling the number of jet nozzles and the pressure.

It should be understood that as l changes during a cleaning operation, the angular displacement will change proportionally. Thus, when conditions warrant that calculation can be taken into account. For example, with a total vertical cleaning interval of 100 ft. at a depth of 12,000 ft. the change in angular displacement will be negligible. However, with an interval of 1500 ft. at a depth of 5,000 ft. the change in angular displacement is significant.

This method may also be used with the other carriers described above such as the carrier 49 shown in FIG. 4. As the carrier 49 is moved vertically and displaced by varying the pressure, the water will be jetted in streams against the liner 16 forming a particular track pattern on the face of the liner. The track pattern for the jet nozzle configuration shown in the embodiment of FIG. 4 employed in the method in which the pressure is varied during a pass is shown in FIG. 5. Referring to FIG. 5, a portion of the well liner 16 is shown with a plurality of track patterns labeled generally 52. Each of the track patterns 52 is mutually parallel and spaced a given distance which will be dependent upon the width of the streams as they hit the liner 16, the angular displacement and the vertical speed of the carrier.

Each track for a given nozzle forms a generally zigzag pattern. Three of the points along one of the track patterns have been labeled 54, 56 and 58 respectively. The track segment between the point 54 and the point 56 is produced by the vertical movement of the carrier along with an angular displacement in a counter clockwise direction. By way of example, if at point 54 the pressure is increased 500 psi, in a pressure environment of 7500–8000 psi, the carrier will rotate 18 degrees. This angular displacement is transformed into the horizontal component of the segment between the point 54 and the point 56. The track segment between the point 56 and the point 58 represents the vertical movement of the carrier along with a pressure change producing rotation in a clockwise direction. By way of example, if at point 56 the pressure is decreased 500 psi, the carrier will rotate 18 degrees in a clockwise direction and this is transformed into the horizontal component of the segment between the point 56 and the point 58. Thus, the track pattern between the point 54 and the point 58 represents one full cycle of a pressure change.

A second method of operation is to keep the pressure constant during a single pass along the cleaning interval and then vary the pressure, producing an angular rotation before the next pass. For example, the carrier could be lowered in a downward pass adjacent the perforations to be cleaned at a pressure of 8000 psi and then upon completing the pass, the pressure varied to 7500 psi producing an angular displacement of 18°. The carrier would then be raised in the next upward pass at this new pressure. In this manner, the liner would be cleaned in a number of passes. This method has an important advantage over the first method in that by moving vertically only at one speed during a pass, the rotational lag effects of friction between the coiled tubing and the inside diameter of the liner or casing is almost eliminated. Moreover, the cam-throttle linkage is no longer required in this method since the pressure is simply manually verified after each pass.

FIG. 12 illustrates the track pattern for the jet nozzle configuration shown in the embodiments of FIGS. 4 or 6–10 employed in the method in which the pressure is varied before each pass. Referring to FIG. 12, a portion 59 of the well liner 16 to be cleaned is shown with eight track patterns labeled generally 60. Each of the eight track patterns is in turn formed from a downward pass track 62 (shown as a dark strip) and an upward pass track 64 (shown as a dotted strip).

The vertical length of the tracks 60 represents the length of one cleaning interval. In operation the carrier is lowered in a downward pass in the direction indicated by the arrows in FIG. 12. The pressure is held constant during the pass. This downward pass produces 16 vertical tracks eight of which are shown as 62 in FIG. 12.

Since in the preferred embodiments shown in FIGS. 4 and 6–10, there are 16 nozzles spaced over 360°, the center to center circumferential spacing of each of the downward tracks 62 is 22.5°.

After the downward tracks 62 have traversed the cleaning interval, the pressure is changed producing an angular displacement of the carrier. The carrier is then raised in an upward pass in the direction indicated by the arrows. This produces 16 upward tracks, eight of which are shown in FIG. 12 as 64. Each of the tracks 64 are mutually spaced 22.5° also. It should now be understood that by controlling the pressure change and by repeating upward and downward passes the portion 59 of the liner 16 will be completely cleaned. Thus, in order to ensure that each point on the liner is hit by streams at least once, several passes will be required.

The equations for calculating the value of the angular displacement, a, and the number of passes, H, needed to produce theoretical double stream coverage on each point of the liner will now be derived. It should be understood that theoretical double coverage has been empirically chosen as desirable since in order to ensure complete cleaning, at least single coverage is required while more than double coverage produces an inefficient process.

Equation (3) from above provided the angular displacement, a, as follows:

$$a=584TlN_j/(D^4-d^4)G \tag{3}$$

Substituting the value of T given in equation (2) into equation (3) gives the following:

$$a=584FBlN_j/(D^4-d^4)G \tag{4}$$

Further substituting the value of F given in equation (1) into equation (4) gives the following:

$$a=584PABlN_j/(D^4-d^4)G \tag{5}$$

wherein, A = the cross-sectional area of the jet orifice $=\pi(D_j/2)^2$

Therefore, equation (5) can be rewritten as:

$$a=584(\pi)P(D_j/2)^2BlN_j/(D^4-d^4)G \tag{6}$$

substituting the values for the constants, along with a conversion factor for l from feet to inches provides:

$$a=0.00048PD_j^2BlN_j/(D^4-d^4) \tag{7}$$

Next an incremental angular displacement, Δa, is calculated which will incrementally move the jet tracks in a second pass a distance which will achieve center-to-center jet track spacing of $\frac{1}{8}''$. This achieves double coverage for those adjacent tracks because empirically it was determined that the width of a jet track at the target is $\frac{1}{4}''$.

To move radially $\frac{1}{8}''$ the tracks must move through an angle as follows:

$$\begin{aligned}\Delta a &= (\tfrac{1}{8})\,(360°)/\pi D_L \\ &= 360/\pi D_L\, N_c\end{aligned} \tag{8}$$

wherein, $D_L$ = Inside diameter of the pipe to be cleaned $N_C$ = Number of jet tracks per circumferential inch = 8 (preferred embodiment)

Then solving equation (7) for P provides:

$$P = \frac{a\,(D^4 - d^4)}{.00048\, D_j^2 BlN_j} \tag{9}$$

In order to determine an incremental pressure, ΔP, which is necessary to move the carrier tracks through an angle, Δa, in a second pass, a from equation (8) is substituted into equation (9) as follows:

$$\Delta P=360(D^4-d^4)/0.00048D_j^2BlN_j\pi D_LN_c \tag{10}$$

Since in the preferred embodiment $N_j=16$ and $N_c=8$, equation 10 can be simplified as follows:

$$\Delta P = \frac{1865\,(D^4 - d^4)}{D_j^2 BlD_L} \tag{11}$$

Although the above equation has included the preferred values for the variables $N_j$, $N_c$ and G it should be clear that a more general form of equation 11 can be written as follows:

$$\Delta P = \frac{0.02082\,(D^4 - d^4)G}{D_L N_c D_j^2 BlN_j}\,. \tag{11a}$$

It should be understood that the above calculations can be performed to produce liner coverage other than double coverage. Thus, to produce single coverage, one quarter inch (the width of the streams), would be substituted into equation (8). Preferably, the liner coverage achieved will be at least once, but not more than twice so that center to center spacing of adjacent streams is equal to or one half the width of the fluid streams.

The number of passes, H, which will be required to clean the liner can be expressed as follows:

$$H = (\pi D_L)\ (1\ \text{track}/\tfrac{1}{8}\ \text{in})/(16\ \text{tracks}) \tag{12}$$

-continued $$= \pi D_L N_c / N_j$$

It should be understood that the value of H should be rounded up to the next integer to insure the number of passes required to produce complete double coverage.

In summary, equation (11) is used to determine the incremental pressure which is needed to produce overlapping adjacent jet tracks and equation (12) is used to determine the number of passes required to provide double coverage of the entire liner.

As discussed in applicant's co-pending application, Ser. No. 337,371, filed Jan. 6, 1982 which is herewith incorporated by reference in its entirety, the value of the vertical travel rate of the carrier in ft/min, $V_{TV}$, can be calculated to determine a in maximum value of $V_{TV}$ below which the total energy at the nozzles, T.E., needed to clean the particular foreign material from the liner is achieved. This derivation produced the following equation:

$$T.E. = \frac{14.1 D_j^2 P^{3/2} NA}{e^{1/2}[(RD_L/19.09)^2 + (V_{TV}/5)^2]^{1/2}} \quad (13)$$

wherein,

TE=Total energy at the jets—lb.-ft.

$D_J$=Diameter of the jet orifice—in.

P=Pressure drop across the jet—psi

N=Number of jet tracks per inch×2

A=Area of opening to be cleaned—square in.

e=Density of the cleaning fluid—#/Gal. within limits

R=Speed of rotation—RPM $D_L$=Inside diameter of the pipe to be cleaned—inches $V_{TV}$=Vertical moving speed—FPM Alternatively, the total energy TE was expressed as a function of the surface area of the liner to be covered. Thus, the total energy per square inch of liner TE′ was expressed as follows:

$$TE' = \frac{14.1\ D_j^2 P^{3/2} N}{e^{1/2}[RD_L/19.09)^2 + (V_{TV}/5)^2]^{1/2}} \quad (14)$$

Although equations (14) and (15) were derived for a freely rotating cleaning operation, it should be understood that they can be made equally applicable to non-rotating systems as follows:

$$TE' = \frac{141\ D_j^2 P^{3/2} N_c}{e^{1/2} V_{TV}} \quad (15)$$

wherein, $N_c$=Number of jet tracks per circumferential inch=N/2, thus N=2$N_c$

The term RD/19.09 dropped out because there is no horizontal component to the jet track. Equation 13 can also be simplified in the same way that equation 14 has been simplified above. Simplifying equation 13 we have:

$$TE = \frac{70.5\ D_j^2 P^{3/2} NA}{e^{1/2} V_{TV}} \quad (13a)$$

Solving equation (15) for $V_{TV}$ yields the maximum vertical speed in feet per minute for effective cleaning under a given set of circumstances. $V_{TV}$ generally turns out to be in excess of 10 feet per minute which is the slowest effective rate that a continuous coiled tubing can be moved.

In order to determine the energy required at the jets, the cleaning energy required to remove the particular material from a given size liner is empirically determined. For example, the energy which is needed to remove barium sulfate from a liner is relatively high and can be determined empirically. This energy which is required to remove material is defined the cleaning energy, C.E. With cleaning fluids such as water driven through nozzles at standoff distances, L, between about 6–10 times the diameter of the jet orifices, the total energy of the streams TE at the nozzle must be significantly greater than CE to insure cleaning because of a substantial fluid power drop as the streams travel from nozzle to target.

This power drop is a function of the distance between the jets and the liner, i.e., stand-off distance L and the diameter of the jet orifices $D_j$. In the preferred embodiment, $D_j$=0.03 inches. The relationship between the power at the target $P_L$ and the power at the jet $P_O$ is given by the following equation:

$$P_L = P_O C_M C_V^2 (D_j/L)^3 P_L \leqq P_O \quad (16)$$

wherein:

$P_L$=Power at the target in ft-lb/sec $P_O$=Power at jet in ft-lb/sec $C_M$=5.2, a dimensionless constant $C_v$=6.4, a dimensionless constant $D_j$=Nozzle diameter in inches L=distance from the nozzle to the target in inches.

Equation 16 is a combined statement presented by Brown, R. W. and Loper, J. L. in their document "Theory of Formation Cutting Using the Sand Erosion Process", J. Pet. Tech., May 1961 and Forestall, W. and Gaylord, E. W. in their document "Momentum and Mass Transfer in a Submerged Water Jet", Journal of Applied Mechanics, June 1955 which are herein incorporated by reference.

$P_O$ in equation (16) can be expressed as follows:

$$P_O = M_o V_o^2/2 \quad (16a)$$

wherein:

$M_o$=mass of expelled fluid at the jet $V_o$=velocity of expelled fluid at the jet Substituting the value of $P_O$ obtained from equation (16a) in equation (2) provides:

$$P_L = (M_o V_o^2/2) C_M C_V^2 (D_j/L)^3 \quad (16b)$$

It will be understood that equation 16(b) is a generalized statement which includes the loss for velocity fall-off as well as the power loss because of increasing distance.

Substituting the values of $C_m$ and $C_v$ in equation 2 provides:

$$P_L = 213 P_O (D_j/L)^3 P_L \leqq P_O \quad (16c)$$

Equation (16c) is valid when the cleaning fluid is water whose density is from about 8.3 lb/gal to about 8.7 lb/gal and which is substantially free of suspended or entrained solids, but not necessarily dissolved solids.

It turns out that if the ratio of stand-off distance to jet diameter rises above 10, the power drop becomes so great as to be impractical within normal operation limits. If the stand-off distance jet diameter ratio is slightly less than 6 then there is no power drop off. Moreover, it has been empirically determined by early researchers (Bernouli et. al.) that at about a ratio of 1.5 or less no jet power is developed.

However, the use of long-chain molecular weight polymer drastically alters the above power loss relationships. Utilization of a long-chain high molecular weight polymer increases the minimum stand-off distance before significant power loss occurs, to the point where distance efficiency is not considered unless the jet nozzle to target distance is excessive, generally between 60–100 diameters of the jet orifice. However, there is some efficiency loss because as shown in FIG. 11 and as discussed above, the jet impact is not normal to the target surface. This efficiency when the tool body is centralized is described as follows:

$$\frac{TE'(R_p^2 - B^2)^{1/2}}{R_p} \quad (17)$$

wherein,

W = Angle formed by the jet stream on the target and a line drawn through the center of the pipe and the target $R_p$ = Vector between carrier axis and target point S = Vector coincident with stream path of offset jet B = offset distance Equation (17) therefore permits the determination of the total energy needed to produce an effective cleaning energy at the target by calculating the power efficiency of the streams.

I claim:

1. A system for washing pipes, comprising:

a non-rotating tubing string;

a jet carrier attached to said string such that as said carrier rotates through a given angle about the lengthwise axis of said tubing string, a portion of said tubing string will rotate through substantially the same angle, said jet carrier having a generally tubular body with a hollow center which provides a path for a fluid, said body having a central axis;

nozzles mounted to said carrier body;

means for supplying fluid under pressure to said nozzles, each of said nozzles being adapted to expel said fluid against said pipe with a force against the pipe, said force having an equal and opposite reactive force, one or more of said nozzles being mounted in said carrier body such that said reactive force is directionally offset from said carrier axis creating a twisting moment in said tubing string about said axis tending to rotate said carrier about said axis;

means for moving said carrier along the length of a pipe to be cleaned; and means for varying said pressure to angularly displace said carrier.

2. A system for washing pipes, comprising:

a non-rotating tubing string;

means for expelling a stream of fluid against said pipe, said expelling means being attached to said string such that as said expelling means rotates through an angle about the lengthwise axis of said tubing string, a portion of said tubing string will rotate;

means for supplying fluid under pressure to said expelling means;

means for creating a twisting moment in said tubing string tending to angularly displace said expelling means;

means for moving said expelling means along the length of a pipe to be cleaned; and means for varying said twisting moment to vary the angular displacement of said expelling means.

3. The system of claim 2 wherein said tubing in said tubing string is coiled tubing.

4. The system of claim 2 wherein a high molecular weight long chain polymer is added to said fluid.

5. The system of claim 2 wherein said means for moving said expelling means includes means for moving said expelling means along the length of a pipe to be cleaned in a series of passes; and wherein said twisting moment varying means acts to angularly displace said expelling means before each pass.

6. A system for washing pipe comprising:

a non-rotating tubing string, said tubing in the string having a length, l, an outside diameter, D, an inside diameter, d, and a torsional modulus of elasticity, G,;

a jet carrier attached to said string such that as said carrier rotates through a given angle about the lengthwise axis of said tubing string, a portion of said tubing string will rotate through substantially the same angle, said jet carrier having a central axis and a plurality of nozzles spaced along its length;

means for supplying fluid under pressure to said nozzles, said nozzles adapted to expel fluid in streams against said pipe, each of said streams striking said pipe with a force, said force having an equal and opposite reactive force, one or more nozzles being positioned on said carrier such that the reactive force is offset with respect to the axis of the carrier creating a twisting moment, T, in said tubing string tending to rotate the carrier through an angle, a, said angle being defined by the following equation:

$$a = 584TlNj/(D^4 - d^4)G$$

Wherein

T = twisting moment in inch-lbs;

l = length of tubing in inches;

Nj = number of offset nozzles:

D = outside diameter of the tubing in inches;

d = inside diameter of the tubing in inches;

G = Torsional modulus of elasticity of the tubing;

means for moving said carrier along the length of a pipe to be cleaned;

means for varying said pressure to angularly displace said carrier.

7. A system for washing pipes comprising:

a non-rotating tubing string;

a jet carrier attached to said string such that as said carrier rotates through a given angle about the lengthwise axis of said tubing string, the portion of said tubing string closest to said carrier will rotate through substantially the same angle, said jet carrier having a central axis therethrough and having a plurality of nozzles spaced along its length;

means for supplying fluid under a bottom hole differential pressure, P, to said nozzles, said nozzles having orifices with an area, A, to expel said fluid in streams against said pipe, each of said streams striking said pipe with a force, said force having an equal and opposite reactive force, F, said reactive force being equal to P×A, one or more nozzles being oriented on said carrier such that the reactive force, F, is offset a distance, B, with respect to the axis of the carrier creating a twisting moment, T, in said tubing string equal to F×B tending to angularly displace the carrier;

means for moving said carrier along the length of a pipe to be cleaned; and means for varying said pressure to angularly displace said carrier.

8. The system of claim 7 wherein said pressure, P, is greater than or equal to about 5,000 psi and less than or equal to about 8,000 psi.

9. The system of claim 7 wherein the number of said nozzles is no less than about 8 and no greater than about 16.

10. A system for washing pipes, comprising;

a non-rotating tubing string;

a jet carrier attached to said string such that as said carrier rotates through a given angle about the lengthwise axis of said tubing string, a portion of said tubing string will rotate through substantially the same angle, said jet carrier having a central axis and having a plurality of nozzles spaced along its length;

means for suppling fluid under a bottom hole differential pressure, P, to said nozzles, said nozzles having orifices with an area, A, to expel said fluid in streams against said pipe, each of said streams striking said pipe with a force, said force having an equal and opposite reactive force, F, said reactive force being equal to P×A, one or more nozzles being oriented on said carrier such that the reactive force, F, is offset a distance, B, with respect to the axis of the carrier creating a twisting moment, T, in said tubing string equal to F×B tending to rotate the carrier through an angle, a, said angle being defined by the following equation:

$$a=584TlNj/(D^4-d^4)G$$

Wherein

T=twisting moment in inch-lbs;

l=length of tubing in inches;

Nj=number of offset nozzles;

D=outside diameter of tubing in inches;

d=inside diameter of tubing in inches;

G=torsional modulus of elasticity;

means for moving said carrier along the length of a pipe to be cleaned; and means for varying said pressure to angularly displace said carrier.

11. The system of claim 1, 5, 6, or 9 wherein said nozzles have central axes perpendicular to a plane which includes the lengthwise axis of said tubing string.

12. The system of claim 11 wherein at least one of said nozzles has a central axis which intersects the lengthwise axis of said tubing string.

13. A system for washing pipes having openings clogged with foreign material said openings having horizontal axes, comprising:

a non-rotating tubing string;

a jet carrier attached to said string such that as said carrier rotates through a given angle about the lengthwise axis of said tubing string, a portion of said tubing string will rotate through substantially the same angle, said jet carrier having a generally tubular body with a hollow center which provides a path for a fluid, said body having a central axis;

nozzles mounted to said carrier body;

means for supplying fluid under pressure to said nozzles, each of said nozzles being adapted to expel said fluid against said pipe to clean said openings, with a force against the pipe, said force having an equal and opposite reactive force, one or more said nozzles being mounted in said carrier body such that said reactive force is directionally offset from said carrier axis creating a twisting moment in said tubing string about said axis tending to rotate said carrier about said axis;

one or more of said nozzles being mounted in said carrier body such that the force of each nozzle is directionally coincident with the horizontal axis of each corresponding opening being cleaned;

means for moving said carrier along the length of a pipe to be cleaned; and means for varying said pressure to angularly displace said carrier.

14. The system of claim 1, 6, 7, 8 or 13 wherein said means for moving said carrier includes means for moving said carrier along the length of a pipe to be cleaned in a series of passes; and wherein said pressure varying means acts to angularly displace said carrier before each pass to clean said pipe.

15. A method for cleaning a pipe, comprising;

providing a non-rotating tubing string;

providing a jet carrier attached to said string such that as said carrier rotates through a given angle about the lengthwise axis of said tubing string, a portion of said tubing string will rotate through substantially the same angle, said carrier having a central axis and a plurality of nozzles spaced along its length;

supplying fluid under pressure to said nozzles, said nozzles adapted to expel said fluid against said pipe with a force, said force having an equal and opposite reactive force, one or more said nozzles being oriented on said carrier such that the reactive force is directionally offset from said carrier axis creating a twisting moment in said tubing string about said axis tending to angularly displace the carrier;

moving said carrier along the length of said pipe;

varying said pressure to angularly displace said carrier.

16. The method of claim 15 wherein said tubing in said tubing string is coiled tubing.

17. The method of claim 15 additionally comprising adding a high molecular weight long chain polymer to said fluid to focus said fluid streams against the pipe.

18. The method of claim 15 wherein said pressure is greater than or equal to about 5,000 psi and less than or equal to about 8,000 psi.

19. The method of claim 15 wherein the number of said nozzles is no less than about 8 and no greater than 16.

20. The method of claim 11 wherein the moving step includes moving said carrier in a series of passes along the length of said pipe;

and wherein the varying step includes varying the pressure before each pass to displace said carrier angularly before each pass as it moves along the length of said pipe.

21. A method for cleaning pipes, comprising:

providing a non-rotating tubing string;

providing means for expelling a stream of fluid against said pipe, said expelling means being attached to said string such that as said expelling means rotates through an angle about the lengthwise axis of said tubing string, a portion of said tubing string will rotate;

supplying fluid under pressure to said expelling means;

creating a twisting moment in said tubing string tending to effect a first angular displacement of said expelling means;

varying said twisting moment to effect a second angular displacement of said expelling means.

22. The method of claim 16 further comprising:

moving said expelling means in a first pass along the length of said pipe while at said first angular displacement; and moving said expelling means in a second pass along the length of said pipe while at said second angular displacement.

23. A method for cleaning pipes comprising:

providing a non-rotating tubing string;

providing a jet carrier attached to said string such that as said carrier rotates through a given angle about the lengthwise axis of said tubing string, a portion of said tubing string will rotate through substantially the same angle, said jet carrier having a central axis and having a plurality of nozzles spaced along its length;

supplying fluid under a bottom hole differential pressure, P, to said nozzles, said nozzles having orifices with an area, A, to expel said fluid in streams against said pipe, each of said streams striking said pipe with a force, said force having an equal or opposite reactive force, F, said reactive force being equal to $P \times A$, said nozzle being oriented on said carrier such that the reactive force, F, is offset a distance, B, with respect to the axis of the carrier creating a twisting moment, T, in said tubing string equal to $F \times B$ tending to rotate the carrier an angle, a, said angle being defined by the following equation:

$$a = 584 T l N_j / (D^4 - d^4) G$$

Wherein

T = twisting moment in inch-lbs;

l = length of tubing in inches;

$N_j$ = number of offset nozzles;

D = outside diameter of tubing in inches;

d = inside diameter of tubing in inches;

G = torsional modulus of elasticity;

moving the carrier along the length of the pipe in a first pass with the pressure held constant; and changing said pressure to a new value to angularly displace the carrier;

moving the carrier along the length of the pipe in a second pass with the pressure held constant at the new value.

24. Apparatus for washing pipes comprising:

a tube having a first end, a second end and a central axis;

means for providing pressurized fluid to said first end;

a nozzle, having a central stream axis, said nozzle being mounted adjacent to said second end of said tube, said nozzle providing fluid communication between the interior and exterior of said tube, said nozzle being oriented such that when fluid is expelled therefrom a twisting moment is provided about said central axis of said tube, said nozzle being mounted such that as said nozzle rotates through a given angle about the lengthwise axis of the tube said second end of said tube will rotate through substantially the same angle;

means for moving said second end of said tube along the length of a pipe to be washed;

means for varying said pressure to angularly displace said second end of said tube about said central axis of said tube.

25. A method for washing the interior surface of pipes using a tube having a nozzle mounted adjacent one end thereof such that as said one end of the tube rotates through a given angle, said nozzle will rotate through substantially the same angle, the central stream axis of said nozzle being offset from the central axis of said tube so that when fluid is expelled therefrom a twisting moment is created about said central axis of said tube, said method comprising;

inserting the nozzle end of said tube into a pipe to be cleaned;

providing a moment tending to twist the nozzle end of the tube with respect to the remainder of the tube by introducing fluid into the tube under pressure so that at least some of the fluid is forcefully expelled from the nozzle;

varying the angular position of the nozzle with respect to the pipe by varying the pressure of the fluid in the tube.

26. A method for cleaning pipes, comprising:

providing a non-rotating tubing string;

providing a jet carrier attached to said string such that as said carrier rotates through a given angle about the lengthwise axis of said tubing string, a portion of said tubing string will rotate through substantially the same angle, said jet carrier having a plurality of nozzles;

supplying fluid under pressure to said nozzles which expel streams of fluid against the pipe;

creating a twisting moment in said tubing string tending to effect a first angular displacement of said nozzles;

moving said carrier along the length of said pipe at a lengthwise speed in a first pass;

determining an incremental change in angular displacement for each subsequent pass and a number of passes required to produce stream coverage of all points on said pipe to be cleaned at least once but not more than twice;

determining the incremental change in twisting moment needed to produce said incremental change in angular displacement;

moving the carrier along the pipe for said number of passes at said lengthwise speed, each of said passes having said incremental twisting moment change.

27. The method of claim 26 wherein at least one of said plurality of nozzles is positioned on said carrier such that when fluid is expelled therefrom the force created is offset from the axis of the carrier and acts to create said twisting moment;

wherein the step of creating a twisting moment includes supplying fluid under pressure to the offset nozzles;

wherein the steps of determining the incremental change in twisting moment includes determining the incremental change in pressure needed to produce the necessary incremental change in angular displacement;

wherein the step of moving the carrier along the pipe for said number of passes includes providing said incremental change in pressure needed to create said incremental change in twisting moment.

28. The method claim of 27 wherein the length of the tubing in feet is 1, the number of offset nozzles is $N_j$, the outside diameter of the tubing string in inches is D, the inside diameter of the tubing string in inches is d, the torsional modulus of elasticity of the tubing string is G, the inside diameter of the pipe to be cleaned in inches is $D_L$, the number of jet tracks per circumferential inch is $N_c$, the diameter of each of the nozzle openings in inches is $D_j$, the offset distance of the force created by the expulsion of water from the axis of the carrier in inches is B;

wherein the step of determining the incremental change in angular displacement includes:

determining the width of the fluid stream expelled from each of the nozzles;

selecting $N_c$ such that all points in each circumferential inch will be covered at least once but not more than twice;

selecting the change in angular displacement of said carrier according to the equation $$\Delta a = 360/\pi D_L N_C$$

wherein the step of determining the incremental change in twisting moment further includes determining the incremental change in pressure needed to create the incremental change in twisting moment according to the equation $$\Delta P = 0.02082 \frac{(D^4 - d^4)G}{D_L N_c D_j^2 B l N_j}.$$

29. The method of claim 27 wherein the diameter of each nozzle orifice in inches is $D_j$, the pressure drop across each nozzle in pounds per square inch is P, the number of jet tracks per circumferential inch is $N_c$, the density of the cleaning fluid in pounds per gallon is e, the inside diameter of the pipe to be cleaned in inches is $D_L$, the lengthwise speed of said carrier in feet per minute is $V_{TV}$ and said method further comprising:

determining the energy per unit area CE′ needed to remove the undesirable material from the interior of the pipe to be cleaned;

determining the energy per unit area, TE′, at the nozzles needed to produce CE′ at the interior surface of the pipe to be cleaned taking into account the cleaning efficiency loss due to the fact that the fluid streams from any offset nozzles will strike the wall of the pipe to be cleaned at an angle, W, formed between the fluid stream and a line drawn through the center of the pipe at the same level of an offset nozzle and the point on the interior wall of the pipe which is struck by the fluid stream; and selecting the value of $V_{TV}$ which will provide the required energy per unit area according to the equation:

$$TE' = \frac{141\, D_j^2 P^{3/2} N_c}{e^{1/2} V_{TV}}.$$

30. The method of claim 29 wherein all the nozzles are offset by the same distance from the central axis of the carrier, the vector between the carrier axis at the level of each nozzle and the point where the fluid stream strikes the interior surface of the pipe for each nozzle is $R_p$, the vector coincident with the stream path of each of the offset nozzles is S, the offset distance of each of the nozzles from the central axis of the carrier is B; and wherein the step of determining the TE′ needed to produce CE′ at the interior of the pipe to be cleaned includes determining the efficiency, EFF, of the offset streams in accordance with the equation:

$$EFF = TE'(\cos W) = TE' \frac{(R_p^2 - B^2)^{1/2}}{R_p}.$$

31. The method of claim 27 wherein the diameter of each nozzle orifice in inches is $D_j$, the pressure drop across each nozzle in pounds per square inch is P, the number of jet tracks per circumferential inch times 2 is N, the area of the opening to be cleaned in square inches is A, the density of the cleaning fluid in pounds per gallon is e, the inside diameter of the pipe to be cleaned in inches is $D_L$, the lengthwise speed of said carrier in feet per minute is $V_{TV}$, and said method further comprises:

determining the energy, CE, needed to improve the undesirable material from the opening to be cleaned in the pipe;

determining the energy TE, at the nozzles needed to produce CE at the opening to be cleaned in the pipe taking into account the cleaning efficiency loss due to the fact that the fluid streams from any offset nozzles will strike the opening to be cleaned in the pipe at an angle, W, formed between the fluid stream and a line drawn through the center of the pipe at the same level as an offset nozzle and the point in the opening to be cleaned which is struck by the fluid stream; and selecting the value of $V_{TV}$ which will provide the required energy according to the equation:

$$TE = \frac{70.5\, D_j^2 P^{3/2} N A}{e^{1/2} V_{TV}}.$$

32. The method of claim 31 wherein all the nozzles are offset by the same distance from the central axis of the carrier, the vector between the carrier axis at the level of each nozzle and the point where the fluid stream strikes the interior surface of the pipe for each nozzle is $R_p$, the vector coincident with the stream path of each of the offset nozzles is S, the offset distance of each of the nozzles from the central axis of the carrier is B; and wherein the step of determining the TE needed to produce CE at the interior of the pipe to be cleaned includes determining the efficiency, EFF, of the offset streams in accordance with the equation:

$$EFF = TE\,(\cos W) = TE \frac{(R_p^2 - B^2)^{1/2}}{R_p}.$$

33. The method of claim 26 further comprising:

determining the cleaning energy needed to remove the undesirable material from the interior of the pipe to be cleaned;

determining the energy required at the nozzles to produce the cleaning energy needed at the interior surface of the pipe to remove the undesirable material;

selecting said lengthwise speed such that sufficient energy is supplied to remove the undesirable material from the interior of the pipe to be cleaned.

34. The method of claim 26 wherein the diameter of each nozzle orifice in inches is $D_j$, the pressure drop across each nozzle in pounds per square inch is P, the number of jet tracks per circumferential inch is $N_c$, the density of the cleaning fluid in pounds per gallon is e, the inside diameter of the pipe to be cleaned in inches is $D_L$, the lengthwise speed of said carrier in feet per minute is $V_{TV}$; and said method further comprising:

determining the energy per unit area, CE′, needed to remove the undesirable material from the interior of the pipe to be cleaned;

determining the energy per unit area, TE′, at the nozzles needed to produce CE′ at the interior surface of the pipe to be cleaned;

selecting the value of $V_{TV}$ which will provide the required energy per unit area according to the equation:

$$TE' = \frac{141\, D_j^2 P^{3/2} N_c}{e^{1/2} V_{TV}}.$$

35. The method of claim 26 wherein the diameter of each nozzle orifice in inches is $D_j$, the pressure drop across the nozzle in pounds per square inch is P, the number of jet tracks per circumferential inch times 2 is N, the area of the opening to be cleaned in square inches is A, the density of the cleaning fluid in pounds per gallon is e, the inside diameter of the pipe to be cleaned in inches is $D_L$, the lengthwise speed of said carrier in feet per minute is $V_{TV}$, and said method further comprises:

determining the energy, CE, needed to remove the undesirable material from the opening to be cleaned in the pipe;

determining the energy, TE, at the nozzles needed to produce CE at the opening to be cleaned in the pipe; and selecting the value of $V_{TV}$ which will provide the required energy according to the equation:

$$TE = \frac{70.5\, D_j^2 P^{3/2} NA}{e^{1/2} V_{TV}}.$$

* * * * *